US012478178B2

(12) United States Patent
Bhavsar

(10) Patent No.: US 12,478,178 B2
(45) Date of Patent: Nov. 25, 2025

(54) VIRAL TRANSMISSION BARRIER FOR GROUP SETTINGS

(71) Applicant: Atreyus A Bhavsar, Medina, MN (US)

(72) Inventor: Atreyus A Bhavsar, Medina, MN (US)

( * ) Notice: Subject to any disclaimer, the term of this patent is extended or adjusted under 35 U.S.C. 154(b) by 625 days.

(21) Appl. No.: 17/332,999

(22) Filed: May 27, 2021

(65) Prior Publication Data

US 2022/0378201 A1 Dec. 1, 2022

(51) Int. Cl.
*A47B 83/04* (2006.01)

(52) U.S. Cl.
CPC ..... *A47B 83/04* (2013.01)

(58) Field of Classification Search
CPC ..... A47B 83/04; A47B 41/00; A47B 41/02; E04B 2/74; E04B 2/7401
See application file for complete search history.

(56) References Cited

U.S. PATENT DOCUMENTS 1,992,903 A * 2/1935 Potashnik ..... A47B 83/02 312/140.3
3,528,559 A * 9/1970 Miller ..... E04B 2/7433 52/285.3
3,538,976 A 11/1970 Gilbert et al.
3,550,540 A 12/1970 Albrecht et al.
3,636,890 A 1/1972 Huff
3,698,104 A * 10/1972 Sutton ..... A47B 41/00 434/432
3,927,481 A * 12/1975 Safranek ..... A47G 5/00 434/432
3,986,461 A * 10/1976 Steele ..... A47F 3/142 434/432
4,759,520 A * 7/1988 Levine ..... A47G 5/00 40/539
4,785,565 A * 11/1988 Kuffner ..... E04B 2/7427 40/605

(Continued)

FOREIGN PATENT DOCUMENTS

CN 209711987 U 12/2019
ES 1247825 * 9/2020 ..... A47B 13/12

(Continued)

*Primary Examiner* — Beth A Stephan
(74) *Attorney, Agent, or Firm* — Berggren Law Offices LLC; William R Berggren

(57) ABSTRACT

A viral transmission barrier suitable for group settings encountered in places such as school or workplace cafeterias. The article aspect is a viral transmission barrier for tables with a height and a top surface with a length, a width, and a perimeter configured to accommodate a group of at least two people that may be strangers sitting in chairs at the perimeter and each having a section of table perimeter before them. Specifically, the article aspect comprises four elements, a multitude of vertical side panels, at least one neighboring vertical panel, a releasably attaching element, and a horizontal ceiling panel. The method aspect is aa method of using a viral transmission barrier to prevent the transmission of airborne viral particles from an infected person to others of a group of at least two people that may include strangers and are sitting in chairs at a table with a perimeter and each having at least 24 in, (61 cm) of perimeter before them at a function where masks are not worn. Specifically, the method comprises five steps.

20 Claims, 15 Drawing Sheets

(56) References Cited

U.S. PATENT DOCUMENTS 4,981,086 A 1/1991 Barca et al.
5,020,684 A * 6/1991 Jow ..... A47G 19/26 220/826
5,065,832 A * 11/1991 Mark ..... A47B 21/06 108/50.13
5,363,616 A * 11/1994 Hernandez ..... A47K 3/36 160/199
5,406,893 A * 4/1995 Burns ..... A47B 41/00 312/196
5,848,497 A 12/1998 Henderson
6,053,588 A * 4/2000 Biggel ..... A47B 21/00 312/258
6,427,609 B1 * 8/2002 Grant ..... E04H 1/1255 108/60
6,453,973 B1 * 9/2002 Russo ..... A47F 5/11 52/592.1
6,615,550 B2 * 9/2003 Reuschel ..... E04H 1/125 52/36.2
6,866,035 B2 3/2005 Haemerle
6,973,927 B1 * 12/2005 Stewart ..... A47J 37/0786 126/29
7,658,199 B2 * 2/2010 Ayers ..... E04H 1/125 135/117
D613,970 S * 4/2010 Switzer ..... D6/699.5
D655,132 S * 3/2012 Chowning ..... D7/412
8,695,250 B2 * 4/2014 O'Connor ..... G09F 15/0068 40/124
9,161,639 B1 * 10/2015 Hundley ..... A47F 3/007
9,637,916 B1 * 5/2017 Lytle ..... E04C 2/543
9,737,142 B2 * 8/2017 Cho ..... H02G 3/0493
10,039,374 B2 * 8/2018 Abraham ..... A47B 13/10
D911,761 S * 3/2021 Sampath ..... D6/714
D941,612 S * 1/2022 Wurm ..... D6/643
11,280,085 B2 * 3/2022 Buffington ..... E04C 2/20
11,291,299 B2 * 4/2022 Isgar ..... A47B 21/02
11,375,808 B1 * 7/2022 Dawson ..... A47B 83/001
11,744,363 B2 * 9/2023 Rozeboom ..... A47B 97/00 52/36.1
11,746,524 B2 * 9/2023 Narbutas ..... E04B 2/824 52/238.1
11,946,244 B1 * 4/2024 Home ..... E04B 1/3444
12,180,704 B2 * 12/2024 Sollie ..... E04B 2/7425
2005/0183639 A1 * 8/2005 O'Leary ..... A47B 83/001 108/60
2012/0055379 A1 * 3/2012 Roberts ..... A47G 5/00 108/50.11
2018/0274231 A1 * 9/2018 Epstein ..... E04B 2/7442
2020/0124292 A1 4/2020 Haemerle
2020/0299957 A1 9/2020 Wang
2020/0352332 A1 * 11/2020 Gass ..... A47B 97/00
2021/0330098 A1 * 10/2021 Udagawa ..... A47B 96/20
2022/0133040 A1 * 5/2022 Godwin ..... A47B 97/00 160/135
2022/0136240 A1 * 5/2022 Sollie ..... E04B 2/7425 160/135
2022/0136661 A1 * 5/2022 Matus, Jr. ..... F21K 9/235 362/235

FOREIGN PATENT DOCUMENTS

KR 102178281 * 11/2020 ..... A47B 17/04
KR 20210011755 A2 2/2021

* cited by examiner

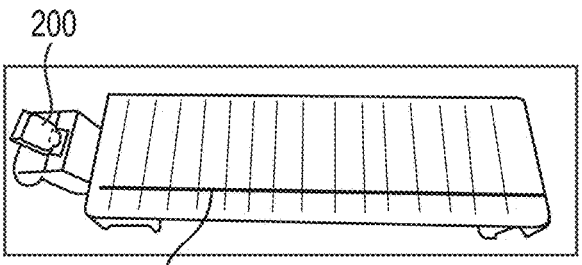
Fig. 11A
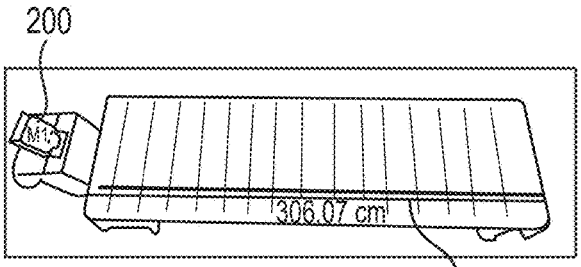
Fig. 11B
Fig. 11

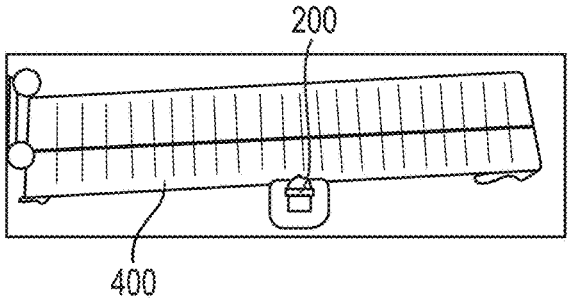
Fig. 12A
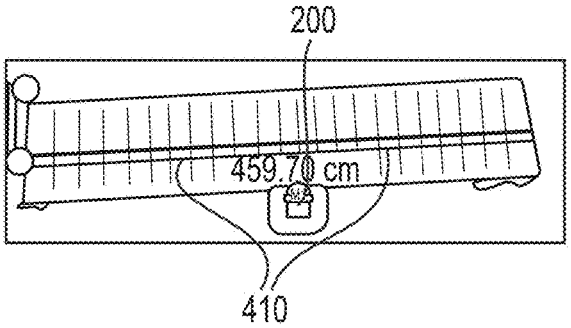
Fig. 12B
Fig. 12

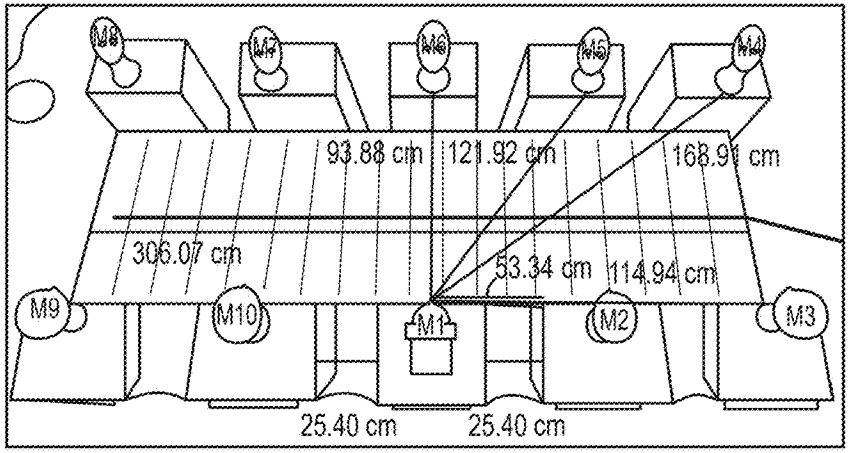
Fig. 13B
Fig. 13
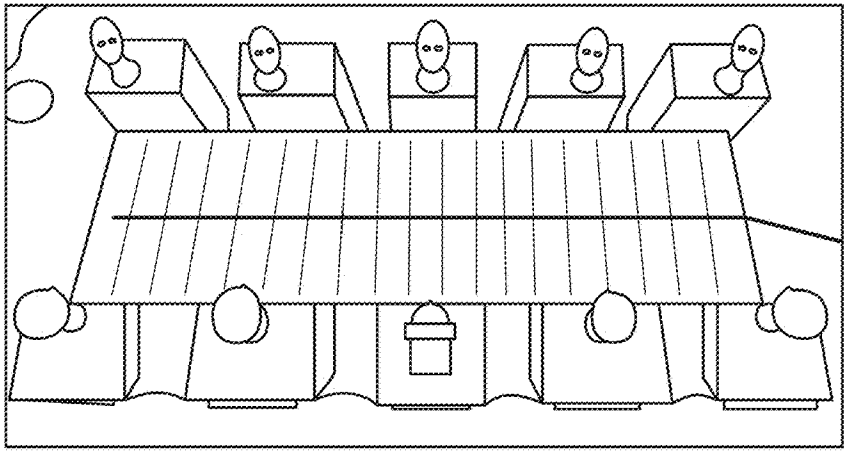
Fig. 13A

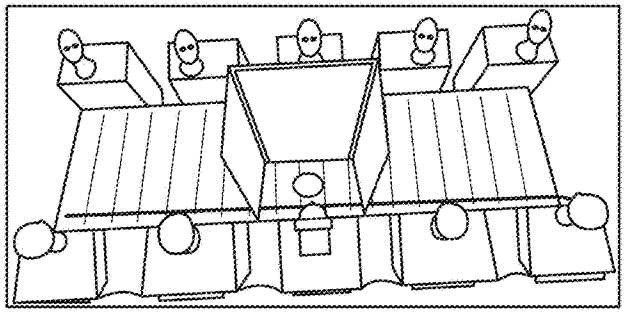
Fig. 14A
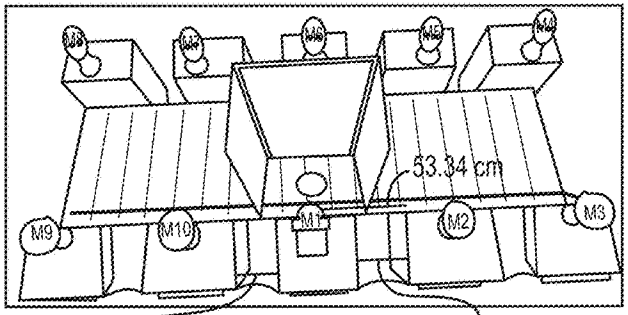
Fig. 14B
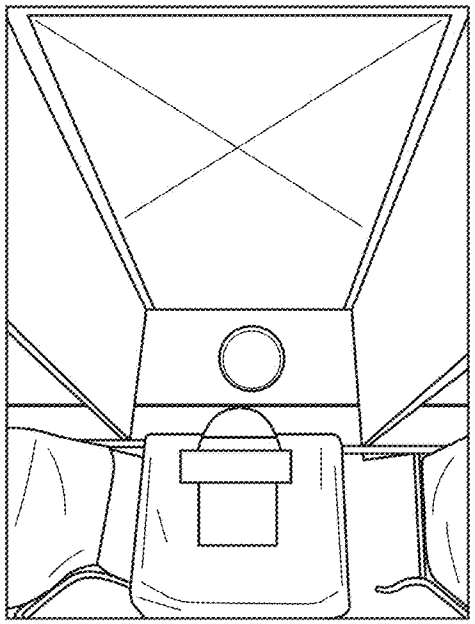
Fig. 14C
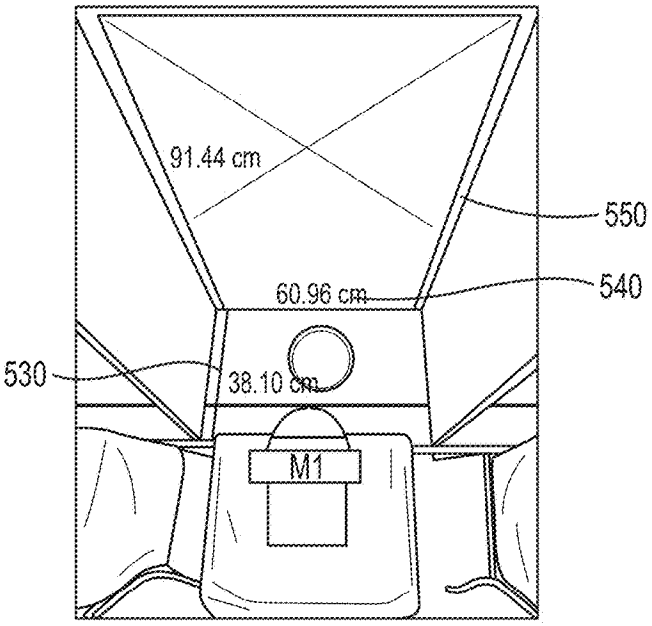
Fig. 14D
Fig. 14

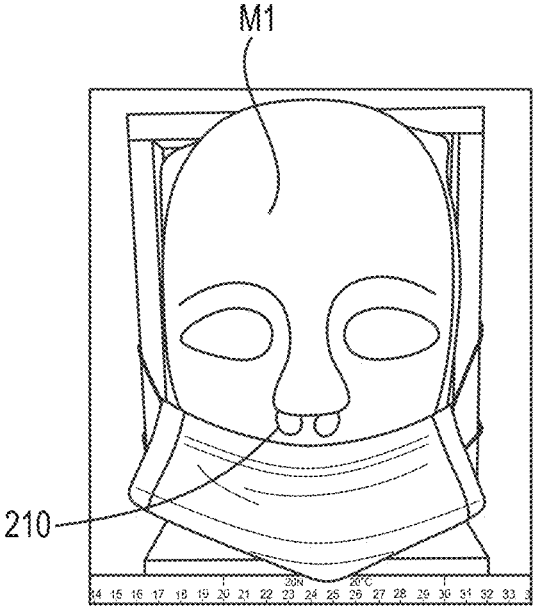
Fig. 16A
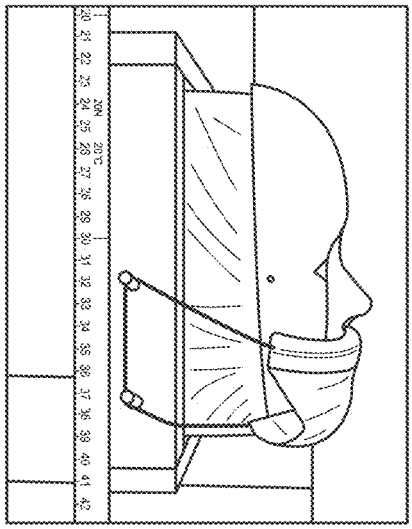
Fig. 16B
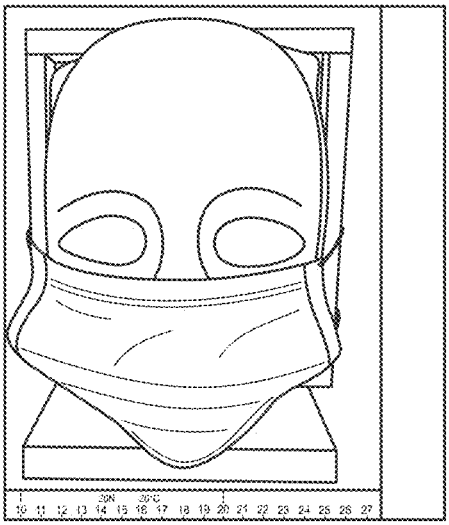
Fig. 16C
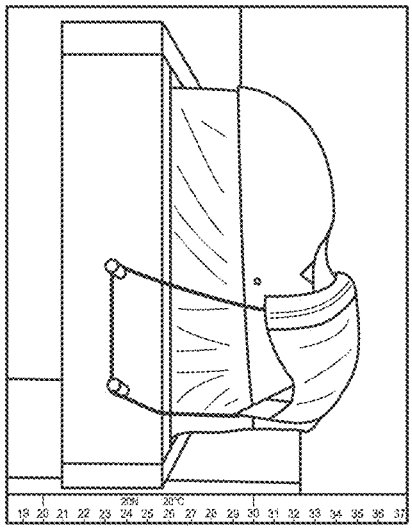
Fig. 16D
Fig. 16

Experiment One

| | Maximum distance of droplet spread, in in. (cm) |
|---|---|
| Trial #1 | 71.5 (181.6) |
| Trial #2 | 80.5 (204.5) |
| Trial #3 | 107.2(272.4) |

Fig. 17

Experiment Two

| | Maximum distance of droplet spread to the left of M1, in in. (cm) | Maximum distance of droplet spread to the right of M1, in in. (cm) |
|---|---|---|
| Trial #1 | 79.0 (200.7) | 72.8 (184.8) |
| Trial #2 | 69.5 (176.5) | 52.3 (132.7) |
| Trial #3 | 67.0 (170.2) | 62.5 (158.8) |

Fig. 18

Experiment Three

| | Mannequins on which droplets were found | Droplets found on the head of the mannequin | Droplets found on the body of the mannequin | Droplets found in the eating space (within 38.10 centimeters from mannequin) of the surrounding mannequins |
|---|---|---|---|---|
| Trial #1 | M5, M6, M7, M8, M10 | M5, M6, M7 | M5, M6, M7, M8, M10 | M2, M3, M4, M5, M6, M7, M10 |
| Trial #2 | M2, M5, M6, M7, M8, M10 | M2, M5, M6, M7, M8, M10 | M6, M7, M8, M10 | M2, M5, M6, M7, M8, M9, M10 |
| Trial #3 | M2, M4, M5, M6, M7, M10 | M2, M4, M5, M6, M10 | M2, M4, M5, M6, M7, M10 | M2, M3, M4, M5, M6, M7, M9, M10 |

Fig. 19

Experiment Four

| Maximum height of droplet spread, in in.(cm) | Droplets found on the cover of the Barrier | Mannequins on which droplets were found with the barrier | Droplets found on the head of the mannequin | Droplets found on the body of the mannequin | Droplets found in the eating space (within 38.10 cm from mannequin) of the surrounding mannequins with the barrier |
|---|---|---|---|---|---|
| 35.1 (89.1) | Yes | None | None | None | None |
| 35.6 (90.5) | Yes | None | None | None | None |
| 34.9(88.7) | Yes | M2, M10 | M2, M10 | M2, M10 | None |

Fig. 20

Experiment Five

| | Mannequins on which droplets were found | Droplets found in the eating space (within 38.10 centimeters from mannequin) of the surrounding mannequins |
|---|---|---|
| Trial #1 | None | None |
| Trial #2 | None | None |
| Trial #3 | None | None |

Fig. 21

| | Experiment One | Experiment Two | Experiment Three |
|---|---|---|---|
| | Maximum radius of droplet spread without wearing a mask, in in. (cm) | Maximum radius of droplet spread when wearing a mask improperly, in in. (cm) | Maximum radius of droplet spread when wearing a mask properly, in in. (cm) |
| Trial #1 | 91.5 (232.4) | 47.0 (119.38) | 0.0 (0.0) |
| Trial #2 | 98.0 (248.9) | 39.0(99.06) | 0.0 (0.0) |
| Trial #3 | 93.3 (236.9) | 43.3 (109.86) | 0.0 (0.0) |

Fig. 22

VIRAL TRANSMISSION BARRIER FOR GROUP SETTINGS

FIELD OF THE INVENTION

This invention relates to a means of blocking viral transmission in group settings, particularly where masks may not be worn.

BACKGROUND OF THE INVENTION

When an airborne virus exists with potentially serious adverse health consequences to people exposed to the airborne virus, there is a need to protect people from exposure. COVID-19 is one such virus. Gatherings of people in large numbers who do not normally live together is particularly problematic. Such situations can occur in such places as, for example, school, workplace, or assisted living cafeterias when physical association of groups of people is desirable such as in schools, workplaces, or assisted living facilities.

Some virus infections that are passed through the air are passed to others breathing in virus particles expelled by coughing from a person sick with the virus. The virus is transmitted (1) by droplets of water, also sometimes called macroscopic droplets, that have a diameter of from about 1 microns (μm) diameter to over 1000 μm or larger that contain virions of the virus, (2) aerosols of water also sometimes called microscopic droplets with a diameter of from less than about 1 μm in diameter to near 0.1 μm that contain virions of the virus, or (3) single virions themselves with a diameter of between 90 and 120 nanometers (nm) or 0.09 μm to 0.12 μm. It is now believed that the vast majority of COVID-19 virions are transmitted to uninfected people by air-borne droplets alone. It is unknown whether the virous is transmitted more by macroscopic or microscopic droplets. Most cloth and surgical masks cannot block transmission of most microscopic droplets. It is also unknown how long a person is infected before showing symptoms.

A common method currently used to prevent transmission of an airborne virus from one who is infected to others that are not is the wearing of masks. The effectiveness of masks depends on the porosity of the masks, i.e., what size particles they are designed to prevent from passing through them, and how securely they are worn on faces covering both the nose and mouth. However, even if effective, they are unable to be worn while a person is eating, such as in a school, workplace, or assisted living facility cafeteria. Moreover, it is possible to be infected but not show symptoms, i.e., be asymptomatic. There is a need for a viral transmission barrier that blocks the transmission of a virus from an infected person to one who is not infected while eating with others who do not normally live with the infected person.

SUMMARY OF THE INVENTION

As places such as schools, businesses, and assisted living facilities open after a widespread airborne viral infection, where masks are routinely worn and social distancing is common, there is a need for viral transmission barriers in places wear masks cannot be worn during a group activity such as, for example eating food in cafeterias or restaurants. I have invented, as result of a study that I conducted that will be discussed later, a viral transmission barrier suitable for the situation encountered in places such as cafeterias.

The article aspect is a viral transmission barrier for tables with a height and a top surface with a length, a width, and a perimeter configured to accommodate a group of at least two people that may be strangers sitting in chairs at the perimeter and each having a section of table perimeter before them. The viral transmission barrier comprises an article aspect and a method aspect.

Specifically, the article aspect comprises four elements, a multitude of vertical side panels, at least one neighboring vertical panel, a releasably attaching element, and a horizontal ceiling panel completely covering the multitude of vertical side panels. The multiple vertical side panels each has a thickness sufficient to permit the vertical side panel to remain in a vertical position for a time exceeding 24 hours, a top edge, and a height configured to extend at least the width of a hand of a sitting person above the head of any person sitting in a chair in front of the table perimeter. Each also has a length configured to have a first edge that extends outwardly beyond the perimeter of the table and a second edge. There is a separation between adjacent vertical side panels where they cross the table perimeter having a length of table perimeter of at least 18 inches (47 centimeters). Each is made of a material that is sufficiently non-porous enough to prevent the transmission through the panel thickness of a virion of an airborne virus with a diameter of at least 50 nanometers and is resistant to degradation from exposure to disinfectant fluids. The at least one neighboring vertical panel has a thickness sufficient to permit the vertical side panel to remain in a vertical position for a time exceeding 24 hours, a top edge, a height configured to extend at least the width of a hand of a sitting person above the head of any person sitting in a chair in front of the perimeter of the table, and a length. It also is made of a material that sufficiently non-porous enough to prevent the transmission through the panel thickness of a virion of an airborne virus with a diameter of at least 50 nm and is resistant to degradation from exposure to disinfectant fluids. The releasably attaching element attached to one of the second edges and the neighboring vertical panel with a seal that is sufficiently tight enough to prevent the passage through the seal of a virion of an airborne virus with a diameter of at least 50 nanometers and that is resistant to degradation from disinfectant fluids. The horizontal ceiling panel is releasably attached to the top edge of each perimeter panel.

The method aspect is aa method of using a viral transmission barrier to prevent the transmission of airborne viral particles from an infected person to others of a group of at least two people that may include strangers and are sitting in chairs at a table with a perimeter and each having at least 24 in, (61 cm) of perimeter before them at a function where masks are not worn. Specifically, the method comprises five steps. The first step is providing a table and chairs for seating a group of at least two people. The second step is providing a virial barrier as discussed above. The third step is releasably affixing the viral transmission barrier on top of the table. The fourth step is seating people at the table to perform activities that require removal of masks. The fifth step is replacing people with other people as tasks are finished.

As used herein,

"rigid panel" means a panel able to remain in a vertical or horizontal position for at least 24 hours without being under tension, "transparent panel" means able for one person to see another person on the other side of a panel while talking to them while sitting in chairs at a table.

The benefits of the invention are several. During a contagion of an airborne virus, groups of unrelated people may now sit at tables to perform tasks where masks cannot be worn without transmitting the virus to those sitting next to them. The invention permits safe interaction with others in that setting. Furthermore, the viral barrier may be easily assembled and disassembled when the space containing the tables with viral transmission barriers is desired for other uses that permit wearing of masks.

BRIEF DESCRIPTION OF THE DRAWINGS

The invention will become more fully understood by the accompanying drawings, wherein like elements are represented by like reference characters, that are given by way of illustration only and thus are not limited to the example embodiments herein.

FIG. 11 is a drawing showing the frontal droplet spread simulation while a person is sitting.

FIG. 12 is a drawing showing the lateral droplet spread simulation while a person is sitting.

FIG. 13 is a drawing of a setup to measure droplet spread for a group sitting at typical seating positions without viral transmission barriers.

FIG. 14 is a drawing of a setup to measure droplet spread for a group sitting at typical seating positions with viral transmission barriers.

FIG. 16 is a drawing of front views and side views of M1 wearing a mask in different positions.

FIG. 17 is a table of the results of Experiment One on straight forward spread of droplet.

FIG. 18 is a table of the results of Experiment Two on lateral spread of droplet.

FIG. 19 is a table of the results of Experiment Three on droplet spread on normal cafeteria table seating positions.

FIG. 20 is a table of the results of Experiment Four on droplet spread on normal cafeteria table seating positions with viral transmission barriers.

FIG. 21 is a table of the results of Experiment Five on droplet spread on normal cafeteria table seating positions with viral transmission barriers having extended vertical side panels.

FIG. 22 is a table of the results of Experiment Six, seven, and eight on droplet spread on normal cafeteria table seating positions with viral transmission barriers having extended vertical side panels.

Figure 1:
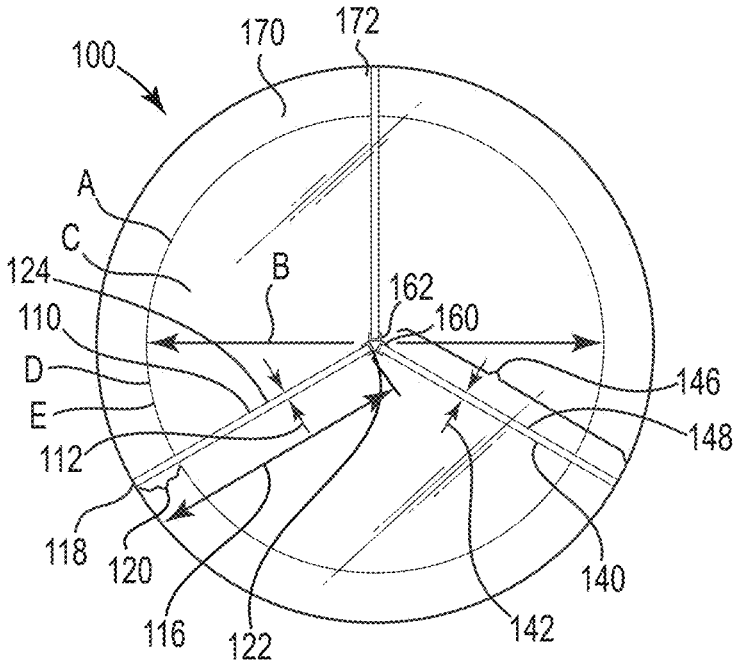
FIG. 1 is a top view of an embodiment of the invention on a small round table.

While the invention is amenable to various modifications and alternative forms, specifics thereof have been shown by way of example in the drawings and will be described in detail below. It is to be understood, however, that the intention is not to limit the invention to the embodiments described. On the contrary, the invention is intended to cover all modifications, equivalents, and alternatives falling within the scope of the invention as defined by the appended claims.

DETAILED DESCRIPTION OF SOME EMBODIMENTS OF THE INVENTION

The invention of a viral transmission barrier in group settings was developed as a way to prevent viral spread where the wearing of masks is not practical, such as in, for example, assisted living facilities, workplaces, and school cafeterias while eating. A series of experiments were conducted to evaluate the distance of simulated respiratory droplet spread and the effectiveness of applying masks and barriers as a mitigation strategy to improve safety.

Activities such as speaking, coughing, sneezing and even breathing produce oral and nasal droplets containing viral particles. Mitigation efforts aimed at tackling COVID-19 spread include covering a person's face with a mask, social distancing, and regular hand washing, appears to be somewhat effective if correctly done. This study was conducted to evaluate the distance of simulated respiratory droplet spread, the effectiveness of applying masks to particle spread, and barriers as a mitigation strategy to improve safety. Activities such as speaking, coughing, sneezing and even breathing produce oral and nasal droplets containing viral particles.

There appear to be two components of a sneeze or cough, a ballistic droplet component and a turbulent gas or puff component which have been visualized using high speed videography, distortion of projected schlieren light beams and shadowgraph imaging. The velocity of the cough airflows has been measured as high as 46 feet per second (ft/s) (14 meters/second (m/s)). The horizontal distance of a gas cloud after a cough or sneeze may travel more than 26.2 feet (ft) (8.0 meters (m) and aerosol transport has been documented at a distance of 13.1 ft (4.0 m). The size of particles ejected during a cough or sneeze ranges from 0.1 to 1000 μm with large droplets called macroscopic droplets having diameters of 1 to 1000 μm or larger and aerosols, called microscopic droplets having diameters of from 1 to 0.1 μm. 90% of viral transmission is now believed to be from aerosol particle under 1 μm. Mathematical models have been used to calculate the effect of drag, diffusion, gravity, humidity, temperature and wind flow on the velocity and distances traveled by respiratory droplets.

While it was previously thought that larger droplets fall to the ground after a short distance, smaller yet still macroscopic droplets may travel farther and be predominantly responsible for transmitting disease. One model of respiratory droplet spread has involved the use of fluorescent dye in a small latex balloon which is inflated until it bursts. The droplets produced have been visualized with an ultraviolet light. This model has been used in multiple experiments to examine the spread of droplets in clinical and surgical settings, with and without masks and various barriers. Surgical masks have been shown to alter and reduce the respiratory jets and droplet spread from coughs and sneezes.

One of the main challenges during the COVID-19 pandemic is the lack of safety measures and guidelines to reduce the risk of viral spread among people during gatherings. A study was conducted to evaluate the distance of oral and nasal droplet spread in a model that simulates coughing and sneezing in a public setting, specifically a school setting, to guide faculty and staff members with safety measures and guidelines to reduce droplet spread. Results could be extended to other public settings such as, for example, workplace and assisted living facility cafeterias. Several models were prepared to observe and visualize the spread of fluid simulating respiratory droplets in places such as the classroom and the cafeteria, in which a student would be more susceptible to contract a virus since individuals cannot wear masks while eating. For all trials, a 1.0 in. (2.5 cm) balloon with 0.3 milliliter (ml) of diluted fluorescent paint was placed inside a mannequin head and was exploded outwards from the mannequin's mouth at 5 pounds per square inch (psi) to generate droplets with an average diameter 100 to 300 μm. Using a black light, the expelled fluorescent macroscopic droplets were visualized. When applying safety precautions and guidelines such as mandating face masks, the results of the experiments conducted in this study with a surgical mask, were extremely positive for the size droplets studied. However, without other safety precautions such as face masks and barriers, social distancing proved to be ineffective. In conclusion the most effective way to prevent droplet spread during activities where masks simply cannot be worn, such as eating, is to apply a viral transmission barrier of the invention between the individuals. Applying viral transmission barriers and properly wearing masks successfully prevented macroscopic droplet spread. For microscopic-sized droplets, only viral transmission barriers still would be effective. Masks would need to be used that could screen smaller particles than surgical masks that were used in this study.

Understanding the maximum spread of oral droplets may assist in producing more effective measures to combat COVID-19 and protect students and faculty when returning to school. The Centers for Disease Control and Prevention (CDC) until recently has recommended that people should practice social distancing at least 6 feet apart in combination with other preventative measures such as wearing face masks. However, many people believe that only social distancing is effective in preventing the spread of COVID-19, leading them to believe that they are safe, when in fact they may not.

As a result of the study that is discussed later, a viral transmission barrier in group settings has been invented that is effective in preventing the spread of COVID-19 and other airborne virus particles where wearing masks is not practical. There are two aspects to the invention, an article aspect and a method of using aspect.

The article aspect is a viral transmission barrier for tables with a height and a top surface with a length, a width, and a perimeter configured to accommodate a group of at least two people that may be strangers sitting in chairs at the perimeter and each having a section of table perimeter before them. The viral transmission barrier comprises an article aspect and a method aspect. Specifically, the article aspect comprises four elements, a multitude of vertical side panels, at least one neighboring vertical panel, a releasably attaching element, and a horizontal ceiling panel.

The first element is the multitude of vertical side panels where each has a thickness sufficient to permit the vertical side panel to remain in a vertical position for a time exceeding 24 hours, a top edge, and a height configured to extend at least the width of a hand of a sitting person above the head of any person sitting in a chair in front of the table perimeter. Each also has a length configured to have a first edge that extends outwardly beyond the perimeter of the table and a second edge. There is a separation between adjacent vertical side panels where they cross the table perimeter having a length of table perimeter of at least 18 inches (47 centimeters). Each is made of a material that is sufficiently non-porous enough to prevent the transmission through the panel thickness of a virion of an airborne virus with a diameter of at least 50 nanometers and is resistant to degradation from exposure to disinfectant fluids.

The dimensions are configured to provide a comfortable eating space in a cafeteria setting that also bars forward and lateral transmission of viral particles. The thickness should be sufficient for the vertical side panels to remain in a vertical position for a time exceeding 24 hours. Lengths of adjacent side panels provide a space in the table perimeter where adjacent vertical side panels cross over the table perimeter that is at least 18 in (47 cm) to comfortably accommodate people at the table that may be children. Some embodiments have a table perimeter space of at least 24 in. (61 cm), some at least 26 kn. (66 cm), some at least 28 in. (71 cm), and some at least 30 in. (76 cm) where larger people are to be accommodated such as office cafeterias. The height is sufficient to achieve comfort for the people sitting at the table and may depend upon the age of the people. Elementary school students may have a maximum height less than high school students where the height extends at least the width of a hand of a sitting person above the head of any person sitting at the table. In some embodiments, the height may extend at least 4 in. (10 cm), in some at least 5 in. (13 cm), in some at least 6 in. (15 cm), and in some at least 7 in. (18 cm) above the head of the tallest person that the viral transmission barrier is configured to accommodate. The first edge of the table extends outward beyond the perimeter of the table to block lateral viral transmission. In some embodiments the extension is at least 5 in. (13 cm), in some 6 in. (15 cm), in some at least 7 in (18 cm), and in some at least 8 in. (20 cm).

The material has several properties. It must be rigid to allow it to remain vertically positioned for at least 24 hours. It must be sufficiently non-porous enough to prevent the transmission through the panel thickness of a virion of an airborne virus with a diameter of at least 50 nanometers and is resistant to degradation from exposure to disinfectant fluids. In addition, some embodiments are transparent, i.e., enabling people sitting before the viral transmission barrier while performing a task such as eating to see others sitting at the table and possibly communicating with them without having theurge to look around the viral transmission barrier to see others. Transparency fosters a sense of community and not one of isolation. Suitable materials include plastics such as Plexiglass and glass.

The second element is the at least one neighboring vertical panel that has a thickness sufficient to permit the vertical side panel to remain in a vertical position for a time exceeding 24 hours, a top edge, a height configured to extend at least the width of a hand of a sitting person above the head of any person sitting in a chair in front of the perimeter of the table, and a length. It also is made of a material that sufficiently non-porous enough to prevent the transmission through the panel thickness of a virion of an airborne virus with a diameter of at least 50 nanometers and is resistant to degradation from exposure to disinfectant fluids. The height and materials are similar to that of the vertical side panels. In some embodiments the neighboring vertical panel is the same as a vertical side panel, in some it is a cylinder configured to be attached to multiple vertical side panels at a distance away from the center of the table, and in some it is a panel extending down the middle of the length of a table.

The third element is the releasably attaching element that is attached to the second edge and a neighboring vertical panel with a seal that is sufficiently tight enough to prevent the passage through the seal of a virion of an airborne virus with a diameter of at least 50 nanometers and that is resistant to degradation from disinfectant fluids. Such a seal is known to the industry and include, for example, (1) round cylindrical base rods affixed to multiple outward extensions with U-shaped cross-sections configured to friction-fit to the second edges of the vertical side panels; (2) flat bases with one side configured to attach to a neighboring vertical panel and the other side having an outward protrusion with a U-shaped cross-sections configured to friction-fit to the second edge of a vertical side panel; and two-part adhesive-backed mechanical fastening tapes configures to adhere to both the sides of vertical side panel at its second end and the length of a neighboring vertical panel to form a seal between two panels. One example of material that may be used for the releasably attaching elements is rubber or another thermoset elastomer.

The fourth element is the horizontal ceiling panel that is releasably attached to the top edge of each perimeter panel and completely covers the multitude of vertical panels. This may be made of similar materials used for the vertical side panels or other materials that are as rigid but less transparent, such as plastics or wood. Generally, materials like those used for the vertical panels are more desirable to encourage a greater sense of community.

The table on which the invention is releasably attached may be round, square, or rectangular. They generally provide a section of perimeter for each person seated before the table of at least 18 in. (47 cm) to 30 in. (76 cm) or larger. Dimensions are provided for common tables but are not meant to limit the scope of the invention. Round tables commonly have a diameter of 42 in. (107 cm) and seat 3 people comfortably. Larger tables may be used with larger diameters and seat 8 people comfortably. Square tables have various side dimensions of at least 30 in. (76) or larger and generally seat 4 people comfortably. Rectangular tables, commonly used in school cafeterias, generally have a width of at least 60 in. (152 cm) and a length of at least 120 in. (305 cm), and generally seat 8 people comfortably with a perimeter of at least 30 in. (76 cm).

In some embodiments, the tabletop surface on which the viral transmission barrier is releasably attached is circular and the neighboring vertical panel is a vertical side panel. It may cover part of the table or predominately most of the table as desired. Some embodiments are used for large gatherings while others are used to isolate some from large groups.

Because the use of viral transmission barriers for group settings may change with the presence of the infection in the community or the use of the room, some embodiments of the viral transmission barriers may be configured to be disassembled and stored for later use as the tables often are so configured. Viral transmission barriers may contact the top of tables differently. In some embodiments, the viral transmission barrier rests upon the top of a table. In some embodiments, the viral transmission barrier is releasably attached to the top of a table.

The viral transmission barrier of the invention is suitable for tables of different shapes. Depending on the shape of the table, the nature of the neighboring vertical panel may be different. In some embodiments, wherein the top surface of the table is circular with a diameter of around 42 in. (107 cm), the neighboring vertical panel is the same as a vertical side panel and the second ends of each are releasably connected to each other with a releasably attaching element.

In some embodiments, wherein the top surface of the table is circular with a diameter of more than 50 in (127 cm), the neighboring vertical panel of the viral transmission barrier is a cylinder with an outer surface configured with multiple releasably attaching elements configured to releasably attach to the second edge of a multitude of vertical side panels.

In some embodiments, wherein the top surface of the table is circular, the neighboring vertical panel of the viral transmission barrier is a cylinder with an outer surface configured with multiple releasably attaching elements configured to releasably attach to the second edge of a multitude of vertical side panels. This occurs when the circular table has a diameter large enough to seat up to 6 to 10 people comfortably.

In some embodiments, where the top surface of the table is square with a length and a width that are equal, the neighboring vertical panel of the viral transmission barrier is a vertical side panel, and the second ends of each are releasably connected to each other with a releasably attaching element, like with the viral transmission barrier on the small circular table discussed above.

In some embodiments, where the top surface of the table is rectangular with a length and a width that is shorter than the length, the neighboring vertical panel of the viral transmission barrier is a vertical back panel configured to pass down the center of the length of the table and having outer surfaces and multiple releasably attaching elements configured to releasably attach to the second edge of a multitude of vertical side panels. In some embodiments, the releasable attaching elements are on both sides of the vertical back panel, and multiple vertical side panels are releasably attached and extend outward to the nearest long length of the table. In some embodiments, the neighboring vertical panel of the viral transmission barrier is a vertical back panel configured to pass down one edge of the length of the table and having outer surfaces and multiple releasably attaching elements on one side configured to releasably attach to the second edge of a multitude of vertical side panels. In some embodiments, the vertical back panel has a length that runs short of the ends of the table. In some embodiments the vertical back panel has a length that runs to the end of the table. In some embodiments, the vertical back panel extends beyond the ends of the table.

The method aspect is aa method of using a viral transmission barrier to prevent the transmission of airborne viral particles from an infected person to others of a group of at least two people that may include strangers and are sitting in chairs at a table with a section of table perimeter before each of them at a function where masks are not worn. Specifically, the method comprises five steps.

The first step is providing a table and chairs for seating a group of at least two people.

The second step is providing a virial barrier as discussed above.

The third step is releasably affixing the viral transmission barrier on top of the table.

The fourth step is seating people at the table to perform activities that require removal of masks.

The fifth step is replacing people with other people as tasks are finished.

Figures of various embodiments of the viral transmission barrier invention may further increase understanding of the invention.

FIG. 1 is a top view of an embodiment of the invention on a small round table. Shown is a viral transmission barrier (100) suitable for a table (A) that is round with a diameter (B). The table has a top (C), a perimeter (D), an edge (E) that is the same as perimeter D. Viral transmission barrier 100 is shown with multiple vertical side panels (110), each with a thickness (112), a length (116), a first edge (118), a length extension portion (120) that passes beyond perimeter D, and a second edge (122) that is near the center of the table. Multiple vertical side panels 110 are made of a rigid transparent material. Next shown is a neighboring vertical panel (140) with a thickness (142), a length (146) and a material (148) that is rigid and transparent. In this embodiment, neighboring vertical panel 140 is the same as vertical side panel 110 and both are releasably attached to a releasably attaching element (160) with friction-holding grooves (162). A horizontal ceiling panel (170) is also shown on top of and completely covering the multitude of vertical side panels (110) and made of material (172), also rigid and transparent.

Figure 2:
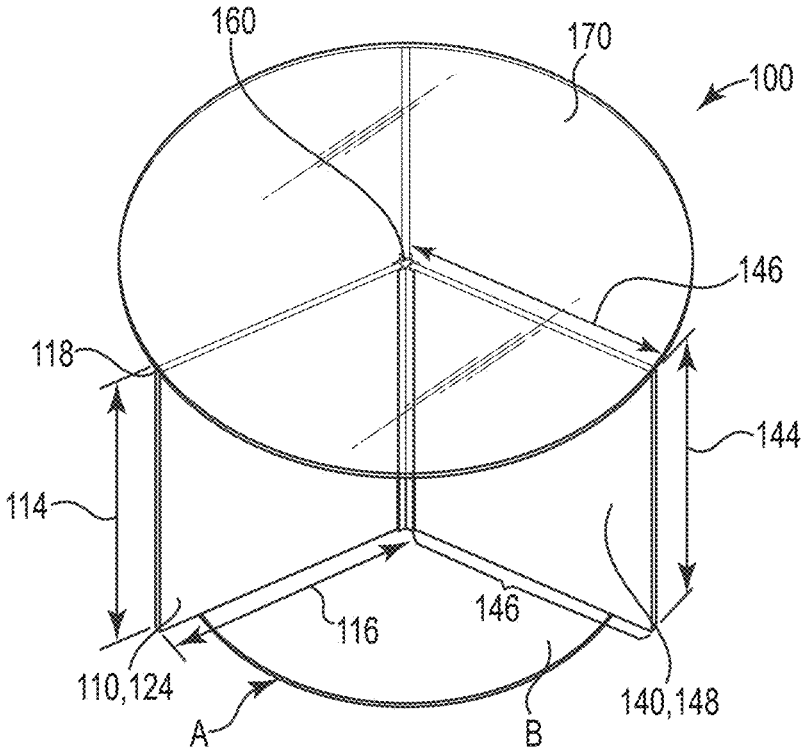
FIG. 2 is a prospective view from the top front of the embodiment shown in FIG. 1.

FIG. 2 is a prospective view from the top front of the embodiment shown in FIG. 1. The height (114) of vertical side panel 110 and the height (144) of neighboring vertical panel 140 are now visible, and top 170 is better seen.

Figure 3:
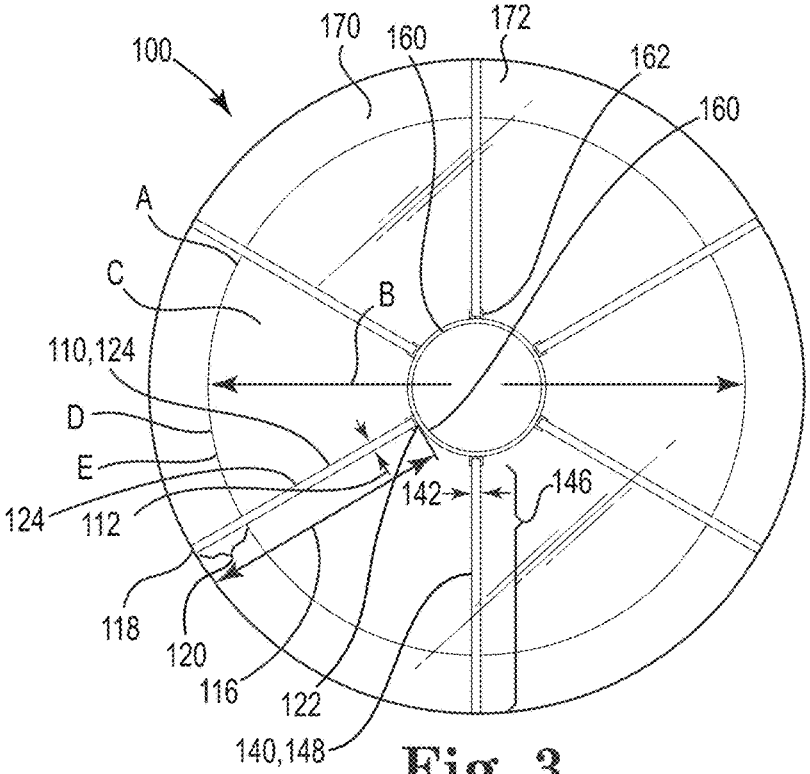
FIG. 3 is a top view of an embodiment of the invention on a large round table.

FIG. 3 is a top view of an embodiment of the invention on a large round table. Shown is viral transmission barrier 100 suitable for table A that is round with a large diameter B. The table has top C, perimeter D, and edge E that is the same as perimeter D. Viral transmission barrier 100 is shown with multiple vertical side panels 110, each with thickness 112, length 116, first edge 118, length extension portion 120 that passes beyond perimeter D, and second edge 122 that is a distance from the center of the table. Multiple vertical side panes 110 are made of a rigid transparent material. Next shown is neighboring vertical panel 140 similar to vertical side panel 110 with thickness 142, length 146, and material 148 that is rigid and transparent. In this embodiment, releasably attaching element 160 is a cylinder that is configured to be attached to multiple second ends at a distance from the center of the table. Vertical side panel 110 and neighboring vertical panel 140 are shown releasably attached to the outer surface of releasably attaching elements 160 with friction-holding grooves 162. Horizontal ceiling panel 170 is also shown on top of and completely covering the multitude of vertical side panels 110 and made of material 172, also rigid and transparent.

Figure 4:
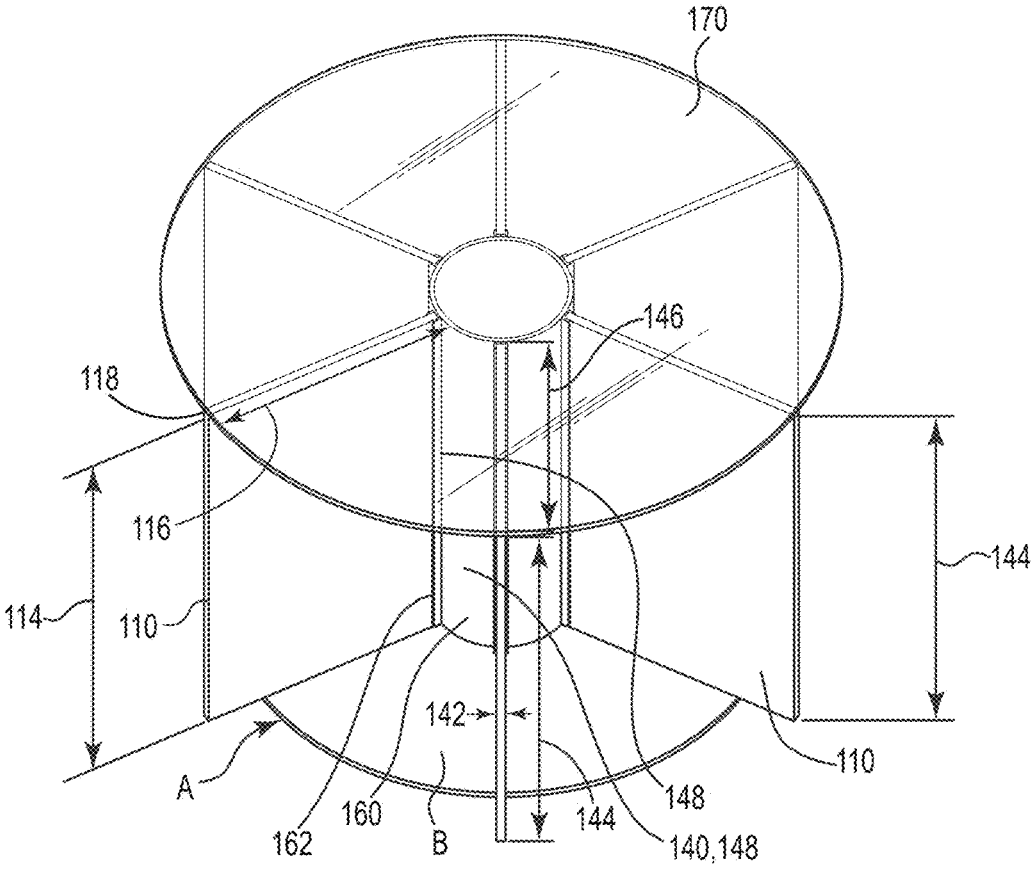
FIG. 4 is a prospective view from the top front of the embodiment shown in FIG. 3.

FIG. 4 is a prospective view from the top front of the embodiment shown in FIG. 3. Height 114 of vertical side panel 110 and height 144 of neighboring vertical panel 140 are now visible, and horizontal ceiling panel 170 is better seen. Attachment is by releasably attaching elements 160 affixed to the outer surface of neighboring vertical panel 140 with friction-holding grooves 162.

Figure 5:
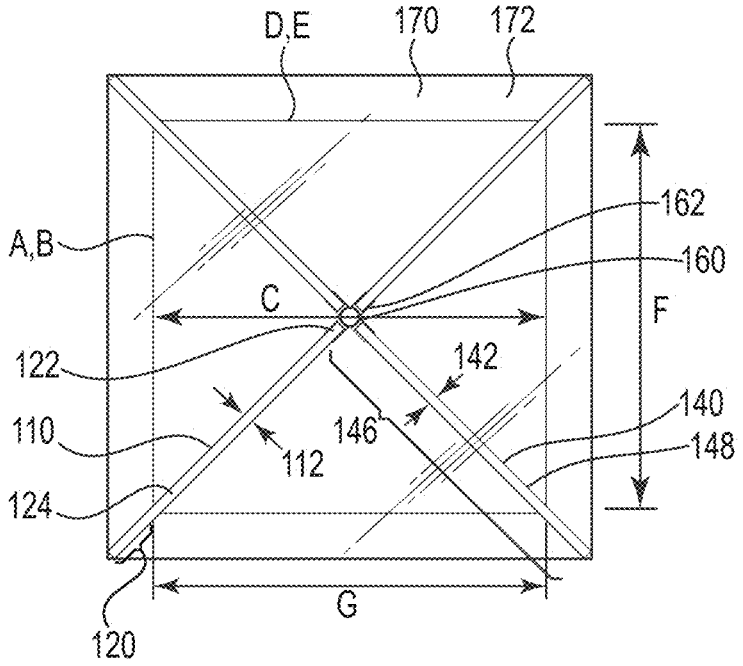
FIG. 5 is a top view of an embodiment of the invention on a square table.

FIG. 5 is a top view of an embodiment of the invention on a square table. Shown is viral transmission barrier 100 suitable for table A that is square with a width (F) and a length (G) that are equal. The table has top C, perimeter D, and edge E that is the same as perimeter D. Viral transmission barrier 100 is shown with multiple vertical side panels 110, each with thickness 112, length 116, first edge 118, length extension portion 120 that passes beyond perimeter C, and second edge 122 that is a distance from the center of the table. Multiple vertical side panes 110 are made of a rigid transparent material. Next shown is neighboring vertical panel 140 with thickness 142, length 146 and material 148 that is rigid and transparent. In this embodiment, neighboring vertical panel 140 is the same as vertical side panel 110 and both are releasably attached to a releasably attaching element 160 with friction-holding grooves 162. Horizontal ceiling panel 170 is also shown on top of and completely covering the multitude of vertical side panels 110 and made of material 172, also rigid and transparent.

Figure 6:
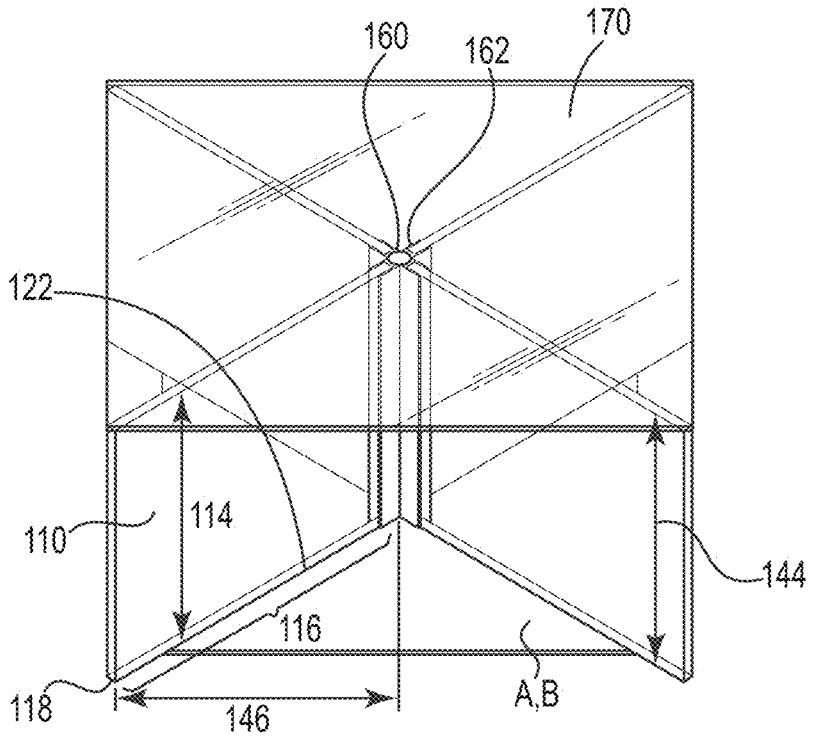
FIG. 6 is a prospective view from the top front of the embodiment shown in FIG. 5.

FIG. 6 is a prospective view from the top front of the embodiment shown in FIG. 5. Height 114 of vertical side panel 110 and height 144 of neighboring vertical panel 140 are now visible, and horizontal ceiling panel 170 is better seen. Neighboring vertical panel 140 is the same as vertical side panel 110 and both are releasably attached to a releasably attaching element 160 with friction-holding grooves 162.

Figure 7:
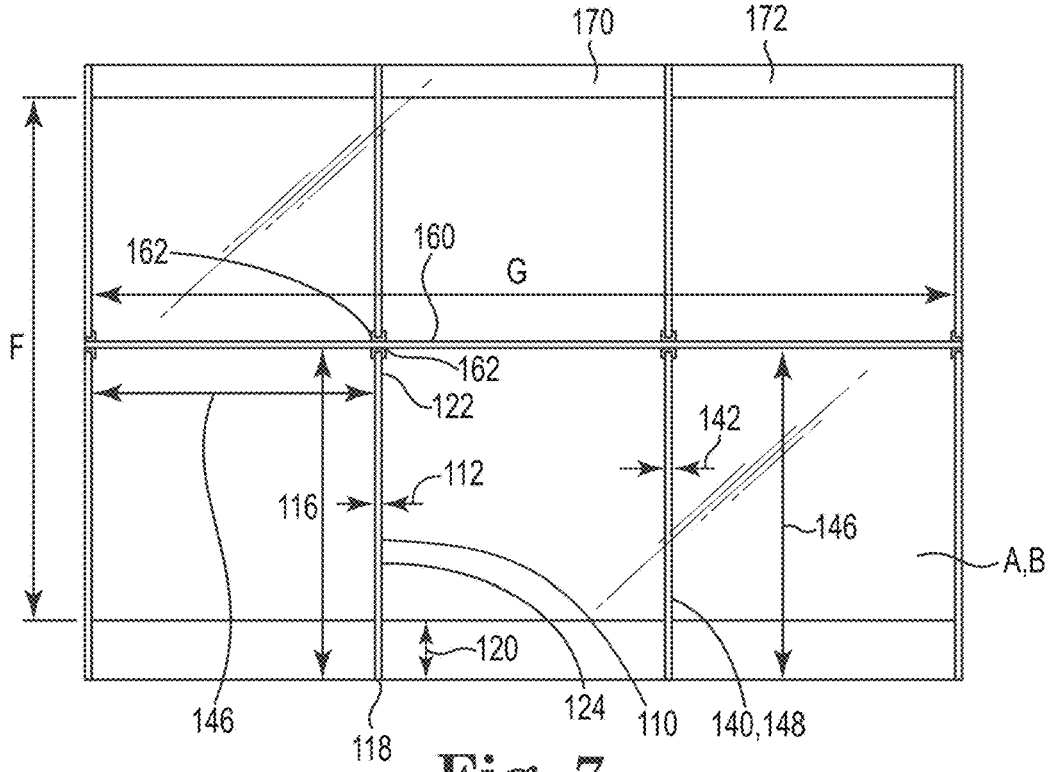
FIG. 7 is a top view of an embodiment of the invention on a rectangular table.

FIG. 7 is a top view of an embodiment of the invention on a rectangular table. Shown is viral transmission barrier 100 suitable for table A that is rectangular with width F and length G that is longer than width F. The table has top C, perimeter D, and edge E that is the same as perimeter D. Viral transmission barrier 100 is shown with multiple vertical side panels 110, each with thickness 112, length 116, first edge 118, length extension portion 120 that passes beyond perimeter D, and second edge 122 that is near the longitudinal center of the table. Multiple vertical side panes 110 are made of a rigid transparent material. Next shown is neighboring vertical panel 140 as a vertical panel running down the center of the length of the table with thickness 142, length 146 and material 148 that is rigid and transparent. In this embodiment, neighboring vertical panel 140 runs down the center of the length of the table and is configured to be attached on both sides to multiple second ends along the way. Attachment is by releasably attaching elements 160 affixed to the outer surface of neighboring vertical panel 140 with friction-holding grooves 162. Horizontal ceiling panel 170 is also shown on top of and completely covering the multitude of vertical side panels 110 and made of material 172, also rigid and transparent.

Figure 8:
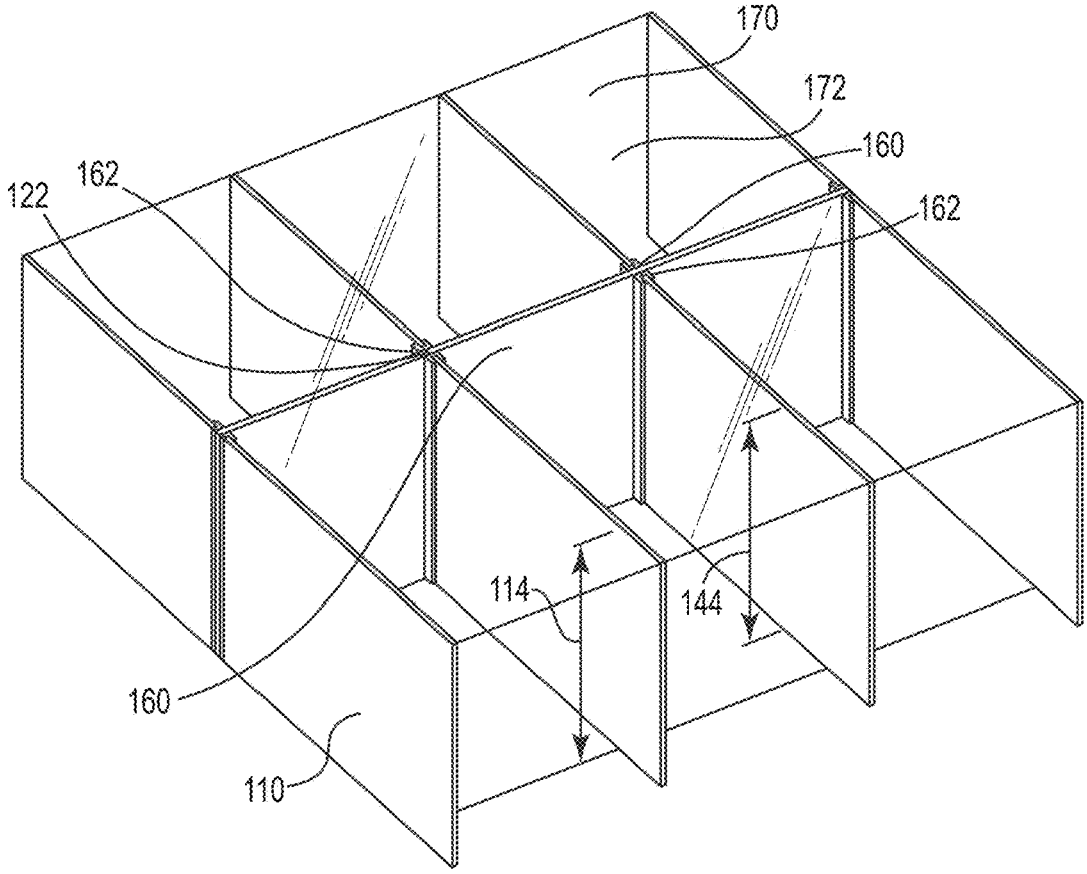
FIG. 8 is a prospective view from the top front of the embodiment shown in FIG. 7.

FIG. 8 is a prospective view from the top front of the embodiment shown in FIG. 7. Height 114 of vertical side panel 110 and height 144 of neighboring vertical panel 140 are now visible, and horizontal ceiling panel 170 is better seen. Attachment is by releasably attaching elements 160 affixed to the outer surface of neighboring vertical panel 140 with friction-holding grooves 162.

The study that led to discovery of the above invention consisted of eight experiments, each done with three trials. The following are descriptions of the materials and methods used, the nine experiments conducted, and results gained.

Materials and Methods

Figures 9, 9A, 9B, 9C:
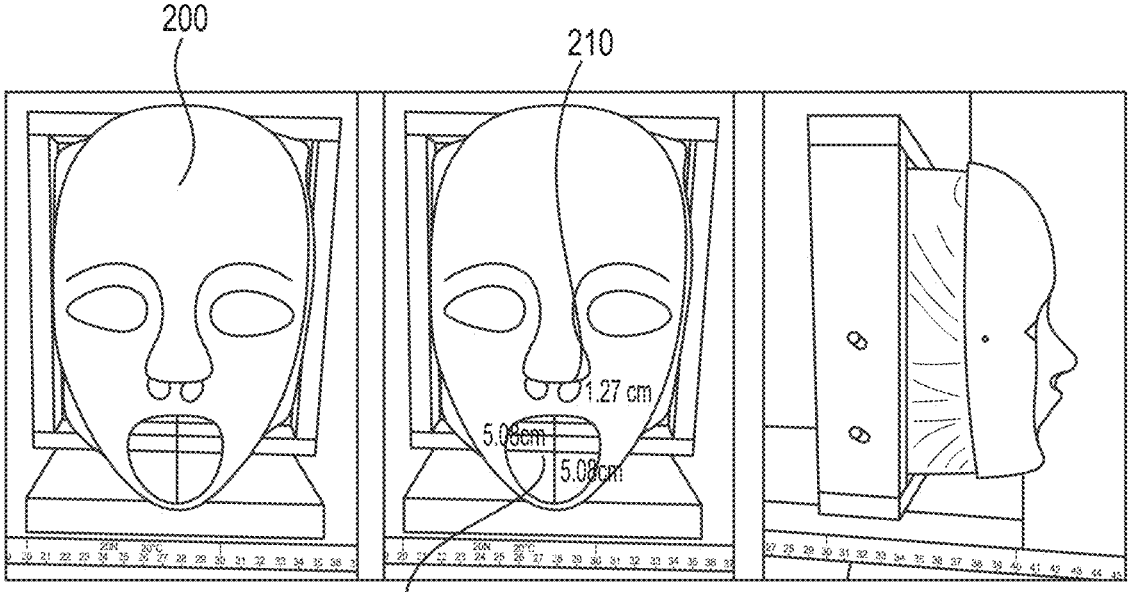
FIG. 9 is drawing of three views of the mannequin head M1 where A is the front view, B is the front view showing measurements of the nostrils and mouth, and C is a side view of the mannequin head M1.
Figures 10, 10A, 10B, 10C:
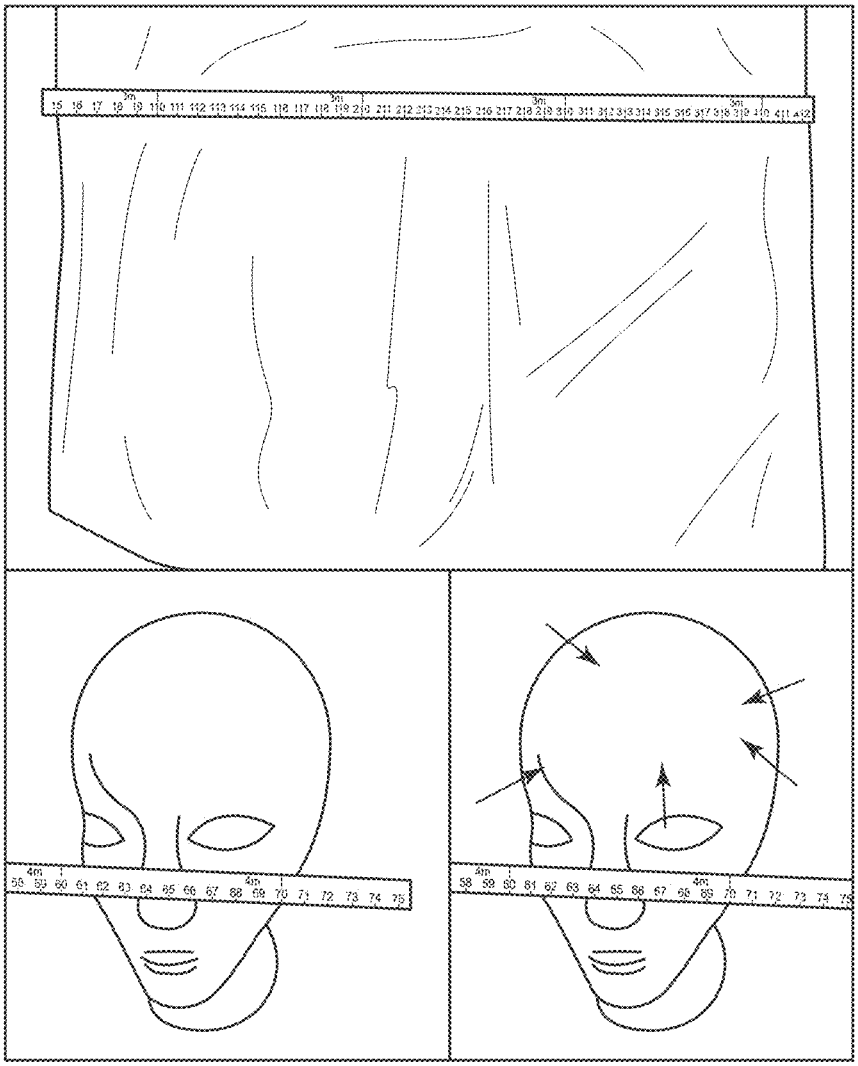
FIG. 10 is a drawing of two sites of droplet deposit, a tabletop and another mannequin surrounding M1.

For each experiment three trials were conducted in a ventilated room simulating a classroom or cafeteria. The tables used in experiments 3 through 6 were adjusted to mimic the exact table dimensions in a local high school cafeteria. The school table dimensions were 10.0 ft or 120.0 in. (306.1 cm) in length, 37.0 in. (94.0 cm) in width, and 30 in. (76.2 cm) in height. In addition, the chairs in the high school cafeteria were 19.0 in (48.3 cm) in height, and the chairs used in this experiment were the same height. For each trial only one mannequin head (M1) simulated a student coughing. To ensure non-contamination and efficiency between each experiment, tablecloths, (from Paper Art Co., Inc., Indianapolis, Indiana, U.S.A.), clear plastic wraps (from Polyvinyl Films, Inc., Sutton, MA, U.S.A,) and plastic bags (from Fleet Farm, Brooklyn Park, MN, U.S.)

were placed on the tables, mannequin heads (from Flora-Craft Corporation, China,) and body and replaced after each experiment. In addition, three different colors of fluorescent paint (from Testors Craft, Hawthorn Pkwy, Vernon Hills, IL, U.S.)—orange, green, and pink—were used for each trial with one color being used per trial. This would allow clear distinction between each trial run. To mimic the viscosity of saliva, 1 mL of fluorescent paint was diluted with the same volume of water. A wooden frame was built around a mannequin mask (from Creatology, China) to simulate a laryngeal cough from the interior, while also resembling a person's head. Plastic was attached between the wooden frame and the mask, and on the eyes, to ensure droplets were only exiting from the mouth and nasal cavity. The mannequin's mouth was cut in a circular shape and had a diameter of 2.0 in. (5.1 cm), and the nostrils were cut the same way and had a diameter of 0.50 in. (1.27 cm to simulate the measurements of a student's mouth and nostrils when coughing. These measurements were obtained from the author's mouth and nostrils as shown in FIG. 9B, and the author has the body habits of a typical high school student. Two screws were placed on the sides of the wooden frame in order to attach the ear loops of a mask to mimic the top and bottom points of an ear as shown in FIG. 9C. Depending on the simulation, whether the mannequin was sitting down or standing up, respectively, two or three identical boxes (Fellowes, U.S) covered with plastic bags which were replaced between each experiment, were placed underneath the wooden frame of the mannequin mask as well as other mannequin heads. These boxes were not only used to support the head of the mannequins but also to simulate the body of a student. All the heights of the mannequins were based on the measurements of the author when sitting at a height of 53.0 in. (134.6) cm and standing at a height of 70.0 in. (177.8 cm). To simulate the cough, an air compressor (Bostitch, U.S.) was used to fill a 1.0 in. (2.5 cm) long latex balloon (TOYSMITH from Toy Investments, Inc., Taichung, Taiwan) filled with 0.3 milliliters (mL) of the diluted fluorescent paint, a reasonable volume of fluid that one might expel when coughing, at the mouth of the mannequin mask and inflated at 5.0 psi until it burst. Five psi has been previously reported as the pressure of a laryngeal cough. After each trial, a black light (Vansky, China) was used in order to observe and record the spread of droplets as shown in FIG. 10A, FIG. 10B, and FIG. 10C. A white metric measuring tape with centimeter and millimeter markings (Lufkin, U.S.) was used to measure the distance of droplet spread.

FIG. 9 shows the dimensions on different views of M1. A white metric measuring tape with centimeter and millimeter marking is shown in each figure. In FIG. 9A, the front of the mannequin head is displayed. The head consists of a wooden base and frame as well as plastic connected to the mask and frame. In FIG. 9B, the measurements of the nostrils (210) and mouth (220) are shown. In FIG. 9C, the side view of M1 is displayed as well as two screws which were used to simulate the human ear to anchor the mask.

FIG. 10 shows droplets on surrounding surfaces. A white metric measuring tape with centimeter and millimeter markings is present in each figure. In FIG. 10A, fluorescent paint droplets can be visualized on the table by illumination with a black light. In FIG. 10B, five fluorescent paint droplets were found on the forehead of one of the mannequins surrounding M1. In FIG. 10C, arrows point to five fluorescent paint droplets on the head of the mannequin.

The purpose of the first five experiments was to simulate the spread of droplets from a student's unprotected cough while seated in a cafeteria setting. The last three experiments were designed to study the spread of droplets and the effectiveness of a mask when standing in an open space such as a hallway.

The first experiment was designed to determine the maximum spread of droplets traveling straight outward from M1. In FIG. 11B, M1 was seated, measuring 53.0 in. (134.6 cm) tall, at one far end of the table. The length of the table was 10.0 ft or 120.0 in. (306.1) cm.

FIG. 11 shows the frontal droplet spread when sitting simulation with a forward trajectory layout (300). A white metric measuring tape with centimeter and millimeter markings is displayed in each figure. In FIG. 11A, a top view is shown of the full table in front of the mannequin head M1 (200) simulating the cough. In FIG. 11B, the exact measurement of the table (310) is labeled, and 200 is labeled as M1.

Similarly, the second experiment was designed to measure the lateral distance of droplet spread. As shown in FIG. 12B, M1 was placed in the middle of the long side of the table which was 15.0 ft or 180.0 in. (459.7 cm) in length, and the maximum distance of droplet spread on both sides of the mannequin head M1 were recorded.

FIG. 12 shows lateral droplet spread when sitting with a lateral trajectory setup (400). A white metric measuring tape with centimeter and millimeter markings is shown in each figure. In FIG. 12A, a top view is shown of the mannequin head M1 simulating the cough placed in the middle of a long table. M1 was placed at the middle of the table to measure the maximum spread of droplets traveling to both sides. In FIG. 12B, the measurement of the length of spread on the table (410) is shown and the mannequin.

For the third experiment, 10 mannequins were oriented in normal eating positions without social distancing measures to examine the spread of droplets. A reasonable distance was used to simulate normal seating positions of students in a cafeteria by orienting them 10.0 in. (25.4 cm) apart between shoulders of neighboring mannequins and the box designating a body having a shoulder width of 16 in. (40.6 cm). All mannequins were aligned symmetrically. Going clockwise from M1, the mannequins were named in consecutive numbers, as shown in FIG. 13B. The distances from M1's mouth going down to the other mannequins' bodies were 21.0 in. (53.3 cm) to M2 as well to M10, 45.3 in. (114.94 cm to M3 and M9, 66.5 in. (168.9 cm) to M4 and M8, 48 in. (121.9 cm) to M5 as well as to M7, and 37.0 in. (94.0 cm) to M6.

FIG. 13 shows measurements of normal seating positions. A white metric measuring tape with centimeter and millimeter markings can be seen in each figure. In FIG. 13A, a top view (500) is shown of 10 mannequins seated in normal positions at a table. These seating positions were designed to mimic students sitting at a cafeteria table without safety protocols. In FIG. 13B, a top view is shown (510) with measurements of distances. All mannequins are labeled as well as the measurements of the distances from the mouth of M1 going down to the bodies of M2, M3, M4, M5, and M6. The shoulder-to-shoulder distance between M1 to M2 as well as M1 to M10 is displayed. The length of the table is also shown.

The purpose of the fourth experiment was to identify the maximum height of droplet spread on the barrier as well as on the top cover of the barrier to determine a sufficient barrier height and whether a top cover was necessary in order to prevent droplets from spreading to the surrounding mannequins and table. To determine if droplets could travel over the barrier, Plexiglass was placed over the top of the barrier. Like the third experiment, the nine other surrounding mannequins were seated in normal eating positions with a barrier around M1, as shown in FIG. 14B with dimensions the same as in FIG. 13B. Three 36.0 in. (91.4 cm) tall white boards were used as the barrier surrounding M1. One of the white boards was placed in front of M1, and the two adjacent whiteboards were placed on the sides, ending at the edge of the table. Plexiglass was applied over the top of the barrier to determine if droplets could travel over the barrier. As shown in FIG. 14D, a comfortable eating space for a student was determined to be 24 in. (61.0 cm) wide by 15 in. (38.10 cm) deep while keeping the barriers as close as possible to reduce the dispersion of droplets.

FIG. 14 shows measurements of normal seating positions and barrier. A white metric measuring tape with centimeter and millimeter markings is shown in each figure. In FIG. 14A, a top view of a group layout (500) with a cubical around M1 is shown of 10 mannequins sitting in the exact same positions as in experiment three. Three whiteboards were positioned in front of the middle mannequin on the bottom of the photo. A plate and a cup were placed on the interior of the whiteboards in front of that mannequin to better simulate the eating space. In addition, Plexiglass can be seen on top of the whiteboards. In FIG. 14B, the group layout (510) is shown with dimensions and the ten mannequins are labeled. In FIG. 14C, a closer picture (520) is shown of the barrier in front of the mannequin simulating the cough as well as a plate and a cup. There is also a metric ruler in front of the mannequin on the table as a scale. In FIG. 14D, the height (550) of panels, length (540) from the mannequin to the front white board, and width (530) of the barrier from mannequin to the side boards is shown, and the mannequin simulating the cough is labeled M1.

Figure 15:
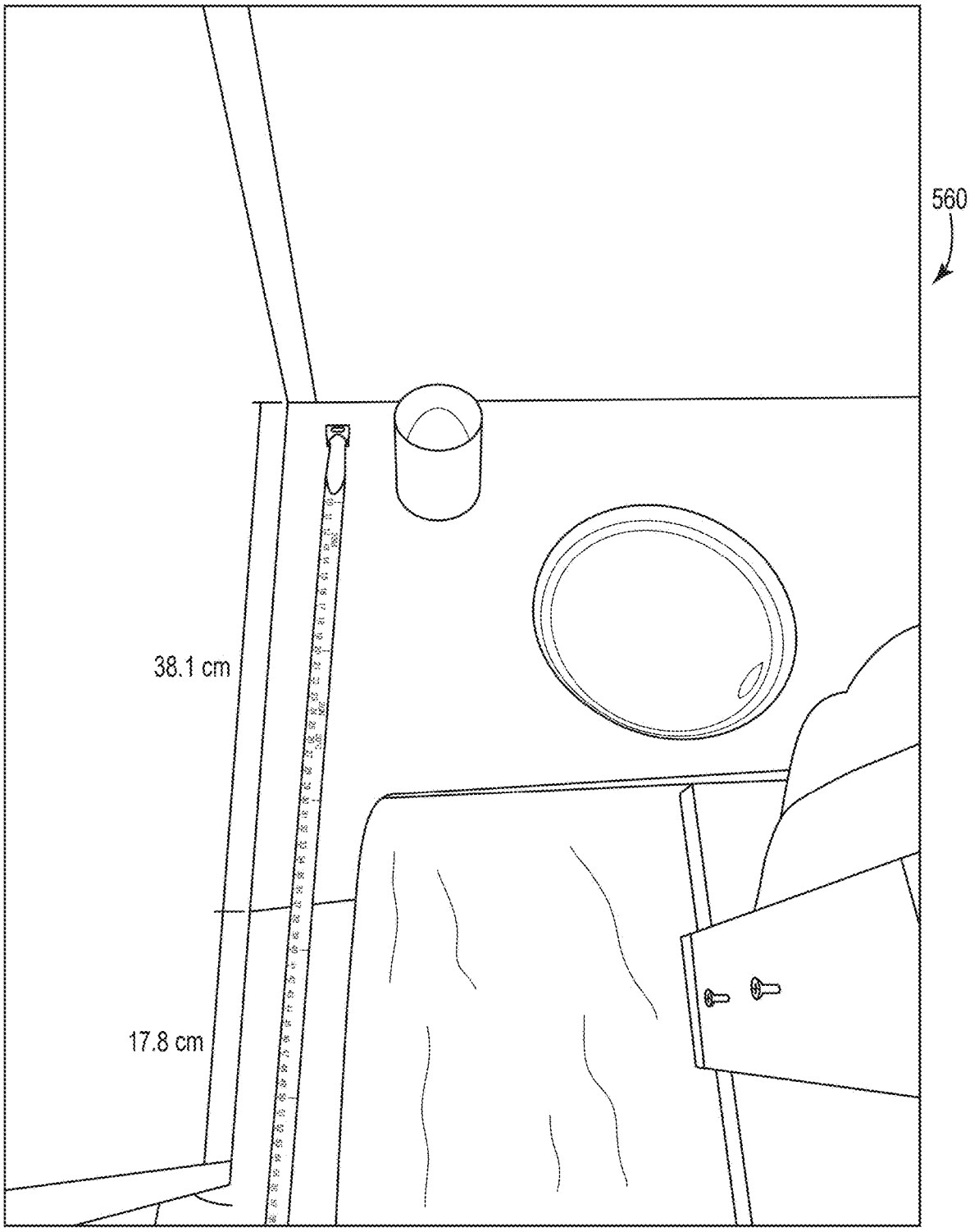
FIG. 15 is a drawing of a setup to measure droplet spread for a group sitting at typical seating positions with viral transmission barriers with extended vertical side panels.

In the fifth experiment, the positions of each mannequin remained constant as in the previous experiment. The two side walls of the barrier were extended off the edge of the table by 7.0 in. (17.8 cm) while the eating space remained the same as shown in FIG. 15. In a similar manner to the previous experiment, the purpose of this experiment was to examine whether droplets would spread anywhere outside of the barrier.

FIG. 15 shows an expanded view (560) of part of the cubical with measurements of extended barrier. The side walls of the barrier have been extended off the edge of the table. There is a white metric measuring tape with centimeter and millimeter markings that travels from the mannequin's eating space off the edge of the table. A plate and cup are also present.

The purpose of the sixth, seventh, and eighth experiments was to simulate the spread of droplets from a person coughing without a mask, with a mask worn improperly, as shown in FIG. 16A and FIG. 16B, and with a mask worn properly, as shown in FIG. 16C and FIG. 16D while standing in an open space such as a hallway. These experiments were designed to assess the effectiveness of a surgical mask by observing if macroscopic droplets were found anywhere beyond the mask. First, tablecloths were placed on the floor, covering a large area surrounding the mannequin. Then, three identical boxes were placed on a chair to mimic the height of a student. The mannequin head was then placed on top of the boxes, reaching a height of 5 ft 10" (177.8 cm). After each trial, a black light was used to examine the droplets on the ground and the data was recorded. In the sixth experiment, no mask war worn. In the seventh experiment, the surgical mask was placed below the nose and only covered the mannequin's mouth as shown in FIG. 16A and FIG. 16B. In eighth experiment, the mask was fitted around the nose and mouth of the mannequin, as shown in FIG. 16C and FIG. 16D.

FIG. 16 shows a frontal and side view of M1 wearing a mask in different positions. A white metric measuring tape with centimeter and millimeter markings is positioned in each figure. In FIG. 16A, the frontal view of M1 wearing a surgical mask improperly is displayed. In FIG. 16B the side view of M1 wearing a surgical mask improperly is shown. In FIG. 16C the frontal view of M1 wearing a surgical mask properly is presented. In FIG. 16D the side view of M1 wearing a surgical mask properly can be seen.

Droplet sizes were measured in experiments three, four, and five with a digital fractional caliper (Ironton, China) with an accuracy of 0.51 mils or 0.013 millimeters (mm) (13 μm)). A total of 67 droplets were measured. The diameter of the largest droplets ranged from 37.4 mils (0.95 mm or 950 μm) to 0.14 in. (3.57 mm or 3457 microns), while the diameter of the smallest droplets ranged from 8.7 mils (0.22 mm or 2220 μm) to 35.8 mils (0.91 mm or 910 μm). Most of the droplets were less than 39.4 mils (1 mm or 1000 μm) in diameter. While these were considerably larger than the diameter of droplets believed to be carrying virus infections as discussed earlier, it is believed that the conclusions of these experiments are still valid. Smaller droplet size wound be expected to travel farther but evaporate more quickly resulting in an unknown resulting distance from coughs.

Results

The results are separated by experiment type, and the distances of droplet spread are listed in ft or in. and cm. The purpose of the first experiment was to examine the maximum distance of frontal droplets spread. The maximum distance of droplets traveling straightforward from M1 was 8.9 ft or 107.2 in. (272.4 cm) with a range of 6.0 ft or 71.5 in. (181.6 cm) to 8.9 ft or 107.2 (272.4 cm) as shown in FIG. 17.

FIG. 17 is a table regarding Experient One showing the maximum distance of droplet spread traveling straight forward on a table. This table shows the measurements of the maximum distance of the frontal droplet spread during a simulated cough that landed on the table.

In the second experiment, which was designed to determine the maximum lateral dispersion of droplets, the maximum distance of droplets traveling to the left of M1 was 6.6 ft or 79.0 in. (200.7 cm) with a range of 5.6 ft or 67.0 in. (170.2 cm) to 6.6 ft or 79.0 in. (200.7 cm). Similarly, the maximum distance of droplets traveling to the right of M1 was 6.1 ft or 72.8 in. (184.8 cm) with a range of 4.4 ft or 52.2 in. (132.7 cm) to 6.1 ft or 72.7 in. (184.8 cm) as shown in FIG. 18.

FIG. 18 is a table regarding Experiment Two showing the maximum distance of droplet spread traveling laterally on the table. This table displays the measurements of the maximum droplet spread travelling laterally from M1.

In experiment three, which was designed to examine the spread of droplets in a cafeteria or classroom setting at a table, macroscopic droplets were found on every mannequin as well as in all their eating spaces, which was within at least 15.0 in. (38.1 cm) from the mannequin. Droplets were found on the bodies and heads of the surrounding mannequins as shown in FIG. 19.

FIG. 19 is a table regarding Experiment Three showing the droplet spread in normal cafeteria seating positions. This table presents the mannequins on which droplets were found as well as the eating spaces on which droplets were found.

The fourth experiment was designed to determine the height of droplet spread on the barrier, as well as whether droplets spread on the inside of the top cover and anywhere outside the barrier. As shown in FIG. 20, the maximum height of droplet spread on the barrier from the fourth experiment was 3.0 ft or 35.6 in. (90.5 cm), with a range of 2.9 ft or 34.9 in. (88.7 cm) to 3.0 ft or 35.6 in. (90.5 cm). Droplets were also found on the inside of the top cover of the barrier in each trial. Droplets were most dense on the board at the height of the mouth of M1 and were found farther spread apart the higher they were found on the board. Droplets were found on the body of M2 and M10 in the third trial.

FIG. 20 is a table regarding Experiment Four showing droplet spread with barrier use. This table shows the maximum height of droplets that traveled on the barrier, the inside of the top cover of the barrier, the surrounding mannequins, and their eating spaces.

The fifth experiment was designed to assess whether droplets were found on surfaces other than the extended barrier. As shown in FIG. 21, there were no droplets found on the body or head of any mannequin as well as in their eating spaces with the use of the extended barrier.

FIG. 21 is a table regarding Experiment Five showing droplet spread with droplet spread with extended barrier use. This table displays the effectiveness of the extended barrier in the fifth experiment.

The sixth, seventh, and eighth experiments were designed to observe the effectiveness of a surgical mask in preventing droplet spread. As shown in FIG. 22 for Experiment Six, droplets were found at a maximum radius of 8.2 ft or 98 in. (248.9 cm) with a range of 7.6 ft or 91.5 in. (232.4 cm) to 8.2 ft or 98 in. (248.9 cm) when coughing standing up without a surgical mask. In Experiment Seven, droplets were found at a maximum radius of 3.9 ft or 47.0 in. (119.4 cm) with a range of 3.3 ft or 39.0 in. (99.1 cm) to 3.9 ft or 47.0 in. (119.4 cm) when coughing standing up with a surgical mask worn improperly. In Experiment Eight, no droplets were found beyond the mask when the mask was worn properly.

FIG. 20 is a table regarding droplet spread with and without a surgical mask. This table shows the spread of droplets without wearing a mask, while wearing a mask improperly, and wearing a mask correctly.

The finding that there were droplets found on the inner surface of the surgical mask (the inside surface of the mask facing the nose and mouth) during each separate trial in Experiment Seven where masks were worn improperly and Experiment Eight where masks were worn properly but not in the space or surfaces around M1 with the mask worn properly, led to the deduction that the mask was preventing droplet spread. Although the assessment of droplet spread on the surrounding surfaces around M1 was performed immediately after the simulated cough, it is possible that rapid evaporation could have led to an underestimate of any droplets that might have penetrated the mask and evaporated prior to observation of the droplets remaining on the surfaces around M1. However, that would presume that there would be no residual fluorescent residue remaining on the surrounding surfaces after potential evaporation and although that is possible, it seems less likely. It is also possible that the large size of the droplets, averaging 100 microns in diameter, may have resulted in a false conclusion that masks worn properly would prevent transmission of droplets. In 2009, four researchers examined how well surgical masks worked to filter small particles, those of 1 micron (1000 nanometers) or less. In a paper called "Filtration performance of FDA-cleared Surgical Masks" the scientists assessed five surgical mask brands. Most mask brands allowed 15 percent or more of 100-nanometer (virion-size) to 1-micron diameter particles through. At least one allowed more than half of those particles through.

Discussion

As schools begin plans to reopen, safety precautions and guidelines need to be established to protect students and teachers from respiratory droplet spread in order to mitigate transmission and infection from COVID-19. The experiments conducted in this study help clarify some characteristics of macroscopic droplet spread which can aid in the implementation of safety measures.

It is not completely known whether respiratory macroscopic droplets can spread beyond 6 ft (1.8 meters (m)). Although, a recently published study showed a simulated jet containing microscopic droplets traveling up to 12 ft (3.6 m), and another recent study shows that turbulent gas clouds can travel 23-27 ft (7.0-8.2 m). However, while suspected by some, it is not proven at this time that microscopic respiratory jets are the predominant mechanism of disease transmission from COVID-19. In fact, macroscopic droplets may be more likely the predominant mechanism involved in disease transmission since many outbreaks such the 1981 outbreak of infectious meningitis in a Texas elementary school involving students who became infected while seated within less than 3 ft (0.9 m) of the first person infected. In this case one could hypothesize that it was the shorter traveling larger droplets that landed on the children which caused the infection, rather than microscopic droplets which are known to travel over 12 ft (3.6 m) away or gas clouds travelling up to 23-27 ft (7.0-8.2 m) away, where none of the other students were infected. In the study described above, it became clear that social distancing at 6 ft (1.8 m) alone was not effective at preventing macroscopic droplet spread. In multiple trials, sitting or standing without a mask or barrier, the maximum distance of macroscopic droplets was found farther than 6 ft (1.8 m) from the mannequin simulating the cough. In the experiments simulating a cafeteria setting, droplets were found in the majority of the other mannequins' eating space. Although it may not seem harmful, if infectious droplets land in one's food, one could be infected. However, when applying a barrier, droplet spread was less. Furthermore, when extending the sides of the barrier 7 in. (17.8 cm) beyond the table perimeter on both sides of M1, the results showed a more protective effect. There was no droplet spread to any of the surrounding mannequins as well as anywhere outside the barrier when a top was included. This would seem to provide protection from sideways spread of droplets that could travel to and infect a person sitting next to the person coughing.

One of the weaknesses of the experiments that were conducted was that only three trials were conducted for each experiment, whereas a larger number of trials would have enabled a more sophisticated statistical analysis. In addition, the mannequins in each experiment were only facing straight, whereas human beings are constantly moving. Moreover, because all experiments were conducted in a ventilated room, droplet spread could have been influenced. Furthermore, an air compressor was used to inflate a balloon filled with fluorescent paint to simulate the cough. If a real human being was used during these experiments, the results may have been different. The viscosity of the fluorescent paint was diluted to mimic the viscosity of saliva. However, the viscosity of the solution or of saliva was not measured. In addition, it was not known whether a cloth mask or an N95 mask would perform differently in these experiments. However, despite these challenges, the strengths of these experiments include the generation of valuable information on droplet spread from a simulated cough. These experiments have consistently shown that macroscopic droplets travel farther than was previously thought. This appears to be the first study to report data on droplet spread using barriers in a cafeteria type setting. In addition, the information provided in this study can help guide mitigation efforts in preventing droplet spread. The prevention of droplet spread can help reduce transmission of the COVID-19 virus during this global pandemic and other airborne inventions in the future.

CONCLUSIONS

Based on the results of these experiments, social distancing at a distance of 6 ft (1.8 m) without a mask or barrier was ineffective at preventing droplet spread. However, a surgical mask was effective at preventing droplet spread anywhere beyond the mask of the coughing mannequin for the size droplets studied. But this would not apply to situations where mask wearing is impractical such as while eating in a cafeteria.

Physical barriers should be established in places where masks are not worn, such as cafeterias in schools, workplaces, or assisted living facilities to limit droplet spread. Clear barriers would seem prudent so that students, workers, or residents would be less likely to lean back to see or to talk to other students, workers, or residents. A barrier that was aligned with the edge of the table was not sufficient to prevent lateral droplet spread. However, lateral droplet spread was eliminated when the barrier was extended to 7 in. (17.8 cm) outwardly beyond the edge of the table on both sides of M1. In addition, droplets were consistently found on the top cover of the barrier, meaning that droplets could travel over the barrier unless a top was included with the barrier. When the barrier extended past the edge of the table with a top, it effectively prevented droplets from spreading anywhere outside the barrier. Based on these findings, it would be prudent for barriers to be constructed following the structure of the viral transmission barriers disclosed above and claimed.

Wearing a mask properly over the mouth and nose or utilizing barriers where masks cannot be worn, such as cafeterias, were effective in preventing macroscopic droplet spread of the droplet size studied. While the effect of masks may change when considering particles from a turbulent cloud, it is not expected to affect the viral transmission blocking benefits of a viral transmission barrier as described above and claimed.

Most importantly, this series of experiments can help guide schools, workplaces, and nursing homes to establish safety guidelines and precautions as they re-open to prevent droplet spread both in the classroom and in the cafeteria setting.

I claim:

1. A viral transmission barrier for tables with a height and a top surface with a length, a width, and a perimeter configured to accommodate a group of at least two people that may be strangers sitting in chairs at the perimeter and each having a section of table perimeter before them, the viral transmission barrier comprising, multiple vertical side panels each having a thickness sufficient to permit the vertical side panel to remain in a vertical position for a time exceeding 24 hours, a top edge, a height configured to extend at least a width of a hand of a sitting person above the head of any person sitting in a chair in front of the table perimeter, a length comprising a first edge that is configured to extend outwardly beyond the perimeter of the table and a second edge, a separation between adjacent vertical side panels of the vertical side panels at points where they cross the table perimeter having a length between the points of at least 18 inches (47 centimeters), and each of the vertical side panels is made of a material that is sufficiently non-porous enough to prevents the transmission through the panel thickness of a virion of an airborne virus with a diameter of at least 50 nanometers and is resistant to degradation from exposure to disinfectant fluids, a neighboring vertical side panel having a thickness sufficient to permit the neighboring vertical side panel to remain in a vertical position for a time exceeding 24 hours, a top edge, and a height configured to extend at least a width of a hand of a sitting person above the head of any person sitting in a chair in front of the perimeter of the table, and a length, and is made of a material that is sufficiently non-porous enough to prevent the transmission through the panel thickness of a virion of an airborne virus with a diameter of at least 50 nanometers and is resistant to degradation from exposure to disinfectant fluids, a releasably attaching element attached to one of the second edges and the neighboring vertical side panel with a seal that is sufficiently tight enough to prevent the passage through the seal of a virion of an airborne virus with a diameter of at least 50 nanometers and that is resistant to degradation from disinfectant fluids, and a horizontal ceiling panel completely covering each of the vertical side panels and spaces between them with a single horizontal ceiling panel such that the horizontal ceiling panel has a perimeter that is greater than the table perimeter and the horizontal ceiling panel is releasably attached to the top edge of each of the vertical side panels.

2. The viral transmission barrier of claim 1 wherein the separation between adjacent vertical side panels of the vertical side panels where they cross the table perimeter has a length of table perimeter of at least 24 inches (61 centimeters).

3. The viral transmission barrier of claim 1 wherein the top surface of the table is circular, and the neighboring vertical side panel is one of the vertical side panels of the vertical side panels.

4. The viral transmission barrier of claim 1 wherein the top surface of the table is circular, and the neighboring vertical side panel is a cylinder with an outer surface configured with the releasably attaching elements, the releasably attaching elements comprising multiple releasably attaching elements, configured to releasably attach to the second edge of the vertical side panels.

5. The viral transmission barrier of claim 1 wherein the top surface of the table is square with a length and a width that are equal, and the neighboring vertical side panel is one of the vertical side panels of the vertical side panels.

6. The viral transmission barrier of claim 1 wherein the top surface of the table is rectangular with a length and a width that is shorter than the length, and the neighboring vertical side panel is a vertical back panel configured to pass down the center of the length of the table and having outer surfaces and the releasably attaching elements, the releasably attaching elements comprising multiple releasably attaching elements, configured to releasably attach to the second edge of the vertical side panels.

7. The viral transmission barrier of claim 1 wherein at least some of the first edges on the lengths extend outwardly at least 5 inches beyond the perimeter of the table.

8. The viral transmission barrier of claim 1 wherein the distance of perimeter between where the first edges of adjacent vertical side panels of the vertical side panels cross the perimeter of the table is at least 30 inches.

9. The viral transmission barrier of claim 1 wherein at least one of the vertical side panels is transparent to permit the viewing of a person through the panels.

10. The viral transmission barrier of claim 1 wherein the neighboring vertical side panel is transparent to permit the viewing of a person through the neighboring vertical panel.

11. A method of using a viral transmission barrier to prevent the transmission of airborne viral particles from an infected person to others of a group of at least two people that may include strangers and are sitting in chairs at a table with a perimeter and each having a section of table perimeter before them at a function where masks are not worn, the method comprising the steps of, providing a table and chairs for seating a group of at least two people;

providing a virial barrier for tables with a height and a top surface with a length, a width, and a perimeter configured to accommodate a group of at least two people that may be strangers sitting in chairs at the perimeter and each having at least 24 inches of perimeter before them, the viral transmission barrier comprising, multiple vertical side panels having a thickness sufficient to permit the vertical side panel to remain in a vertical position for a time exceeding 24 hours, a top edge, a height configured to extend at least a width of a hand of a sitting person above the head of any person sitting in a chair in front of the table perimeter, a length comprising a first edge that is configured to extend outwardly beyond the perimeter of the table and a second edge, a separation between adjacent vertical side panels of vertical side panels at points where they cross the table perimeter having a length between the points of at least 18 inches (47 centimeters), and each of the vertical side panels is made of a material that is sufficiently non-porous enough to prevent the transmission through the panel thickness of a virion of an airborne virus with a diameter of at least 50 nanometers and is resistant to degradation from exposure to disinfectant fluids, a neighboring vertical side panel having a thickness sufficient to permit the neighboring vertical side panel to remain in a vertical position for a time exceeding 24 hours, a top edge, and a height configured to extend at least a width of a hand of a sitting person above the head of any person sitting in a chair in front of the perimeter of the table, and a length, and is made of a material that is sufficiently non-porous enough to prevent the transmission through the panel thickness of a virion of an airborne virus with a diameter of at least 50 nanometers and is resistant to degradation from exposure to disinfectant fluids, a releasably attaching element attached to one of the second edges and the neighboring vertical side panel with a seal that is sufficiently tight enough to prevent the passage through the seal of a virion of an airborne virus with a diameter of at least 50 nanometers and that is resistant to degradation from disinfectant fluids, and a horizontal ceiling panel completely covering each of the vertical side panels and spaces between them with a single horizontal ceiling panel such that the horizontal ceiling panel has a perimeter that is greater than the table perimeter and the horizontal ceiling panel is releasably attached to the top edge of each of the vertical side panels;

releasably affixing the viral transmission barrier on top of the table;

seating people at the table to perform activities that require removal of masks; and replacing people with other people as tasks are finished.

12. The method of claim 11, wherein the tabletop surface is circular, and the neighboring vertical side panel is one of the vertical side panels of the vertical side panels.

13. The method of claim 11, wherein the top surface of the table is circular, and the neighboring vertical side panel is a cylinder with an outer surface configured with the releasably attaching elements, the releasably attaching elements comprising multiple releasably attaching elements, configured to releasably attach to the second edge of the vertical side panels.

14. The method of claim 11, wherein the top surface of the table is square with a length and a width that are equal, and the neighboring vertical side panel is one of the vertical side panels of the vertical side panels.

15. The method of claim 11, wherein the top surface of the table is rectangular with a length and a width that is shorter than the length, and the neighboring vertical side panel is a vertical back panel configured to pass down the center of the length of the table and having outer surfaces and the releasably attaching elements, the releasably attaching elements comprising multiple releasably attaching elements, configured to releasably attach to the second edge of the vertical side panels.

16. The method of claim 11, wherein at least some of the first edges extend outwardly at least 6 inches beyond the perimeter of the table.

17. The method of claim 11, wherein at least some of the first edges extend outwardly at least 5 inches beyond the perimeter of the table.

18. The method of claim 11, wherein the distance of perimeter between where first edges of adjacent vertical side panels of the vertical side panels cross the perimeter of the table is at least 30 inches.

19. The method of claim 11, wherein at least one of the vertical side panels is transparent to permit the viewing of a person through the panels.

20. The method of claim 11, wherein the neighboring vertical side panel is transparent to permit the viewing of a person through the panels.

* * * * *